US006311531B1

(12) United States Patent
Sykes

(10) Patent No.: US 6,311,531 B1
(45) Date of Patent: Nov. 6, 2001

(54) SECURITY STRAP

(75) Inventor: Philip K. Sykes, Shoreview, MN (US)

(73) Assignee: Emplast, Inc., Chanhassen, MN (US)

( * ) Notice: Subject to any disclaimer, the term of this patent is extended or adjusted under 35 U.S.C. 154(b) by 0 days.

(21) Appl. No.: 09/649,535

(22) Filed: Aug. 28, 2000

(51) Int. Cl.[7] ..... E05B 65/00
(52) U.S. Cl. ..... 70/57.1; 292/307 R; 24/16 PB
(58) Field of Search ..... 70/57.1, 18, 19, 70/49; 292/307 R; 24/16 PB; 206/1.5

(56) References Cited

U.S. PATENT DOCUMENTS

| | | | | |
|---|---|---|---|---|
| D. 343,356 | | 1/1994 | Wittman | D9/415 |
| 4,106,801 | * | 8/1978 | De Lima Castro Neto | 292/307 R |
| 5,437,172 | * | 8/1995 | Lamy et al. | 70/57.1 |
| 5,524,463 | * | 6/1996 | Schenkel et al. | 70/57.1 |
| 5,542,724 | * | 8/1996 | Netto | 292/307 R X |
| 5,601,188 | | 2/1997 | Dressen et al. | 206/308.2 |
| 5,788,294 | * | 8/1998 | Leon et al. | 292/307 R |
| 5,791,079 | * | 8/1998 | Mazzucchelli | 70/57.1 X |
| 5,901,416 | * | 5/1999 | Mears | 24/16 PB |
| 5,944,173 | | 8/1999 | Boire et al. | 206/1.5 |
| 6,003,714 | * | 12/1999 | Buermann | 292/307 R X |
| 6,044,669 | * | 4/2000 | Levi | 292/307 R X |
| 6,050,622 | * | 4/2000 | Gustafson | 70/57.1 X |
| 6,092,401 | * | 7/2000 | Sankey et al. | 70/57.1 X |
| 6,102,200 | | 8/2000 | Dressen et al. | 206/308.2 |
| 6,119,314 | * | 9/2000 | Freed | 24/16 PB |
| 6,128,932 | * | 10/2000 | Mainetti et al. | 70/57.1 |
| 6,131,969 | * | 10/2000 | Natkins | 292/307 R X |
| 6,174,006 | * | 1/2001 | Burt | 292/307 R X |

* cited by examiner

*Primary Examiner*—Suzanne Dino Barrett
(74) *Attorney, Agent, or Firm*—Nikolai & Mersereau, P.A.

(57) ABSTRACT

A security device for use in retail establishments to lock onto articles which are for sale and which optionally has enclosed an electronic article surveillance tag to prevent shoplifting. The security device has a locking mechanism which can not be opened without a key. The locking mechanism comprises a pair of asymmetric tines which are on opposite sides of an asymmetric engagement member. To lock the security device the asymmetric engagement member spreads apart the asymmetric tines until the asymmetric engagement member gets passed the asymmetric tines. The asymmetric tines close behind the asymmetric engagement member and lock the asymmetric engagement member in place. The asymmetric tines must be separated by an asymmetric key to allow the asymmetric engagement member to pass by the asymmetric tines to unlock the security device. The asymmetric tines and the asymmetric engagement member are shaped to prevent tampering with the locking mechanism and making the security device harder to open without a complimentary asymmetrically shaped key.

6 Claims, 4 Drawing Sheets

SECURITY STRAP

BACKGROUND OF THE INVENTION

I. Field of the Invention

The present invention relates generally to security devices for items such as clothing, watches, power tools, and other articles having an aperture through which a strap may be passed. The strap forms a loop through the item and is then locked in place by a mechanism passing through an aperture in the strap. More particularly, the present invention relates to a security device having an asymmetric locking mechanism, as well as an internally disposed electronic article surveillance (EAS) tag therewithin and a asymmetric key for unlocking the locking mechanism.

II. Discussion of the Prior Art

In an effort to thwart or eliminate the theft of items offered for sale in stores, retailers have for years worked toward tagging such articles with devices having improved security characteristics. Some devices are rather large and have cumbersome attachment means for securing the device to the item. Some devices are not easily removed from the item at the checkout counter.

To further reduce the likelihood of thievery, some security devices include electronic article surveillance (EAS) tags disposed within the security device so that an alarm will sound within the retail store if a thief attempts to leave the premises without having the store clerk remove or disable the EAS tag.

The security devices must be easily removed from the items sold at the checkout counter prior to the customer leaving the store such that the EAS does not sound. Some thieves have found means to open or remove the devices such that items can be stolen easier. A security device with an EAS and a secure lock which can be easily opened with the proper key but hard to open by other means, is needed by the retail industry.

SUMMARY OF THE INVENTION

The present invention, provides a security device having a strap which can be looped through an aperture in an item and secured by an asymmetric locking mechanism integral with the strap which is difficult to open without an asymmetric key and which resists opening by other means.

The locking mechanism has a door portion and a security device locking mechanism portion attached by a hinge at one side for ease of alignment of the engagement member pod on the door portion with the tine member pod in the locking mechanism portion and for ease of locking and unlocking the security strap. The tine member pod has at least two opposing tines, one on each side of the engaging member. The engagement member is shaped such that the tines will slip over the engaging member when closing the locking mechanism. When the security device locking mechanism is closed the tines will be positioned under the engagement member locking the security device locking mechanism. A key is necessary to move the tines from under the engagement member to open the security device locking mechanism. The engagement members, tines and keys all have asymmetric shapes to deter unauthorized opening of the security devices. The asymmetric tines compliment the shape of the asymmetric engagement portion for ease of closing the security device locking mechanism, and for opening it with the asymmetric key.

The pods have walls, which restrict access to the tines to prevent opening of the security device with an implement other than a key.

The security device has an EAS secured inside of the security device body so that it can not be removed or tampered with.

The security devices can be easy removed at a checkout counter with the key and reused on other items placed on the shelves of the store for sale.

OBJECTS OF THE INVENTION

It is accordingly a principal object of the present invention to provide an improved security device for items placed on display for sale at stores.

It is a further object of the present invention to provide a relatively inexpensive lockable security device that can be used in conjunction with retailers' present electronic anti-theft alarm activators.

It is a further object of the present invention to provide a lockable security device compatible with having an EAS tag therein.

It is yet another object of the invention to provide an asymmetric locking mechanism in the security device.

It is an object of the invention to provide an asymmetric key for opening the asymmetric locking mechanism in the security device.

It is an object of the invention to provide a security device which can easily attach to items having an aperture for placing the security device strap through.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
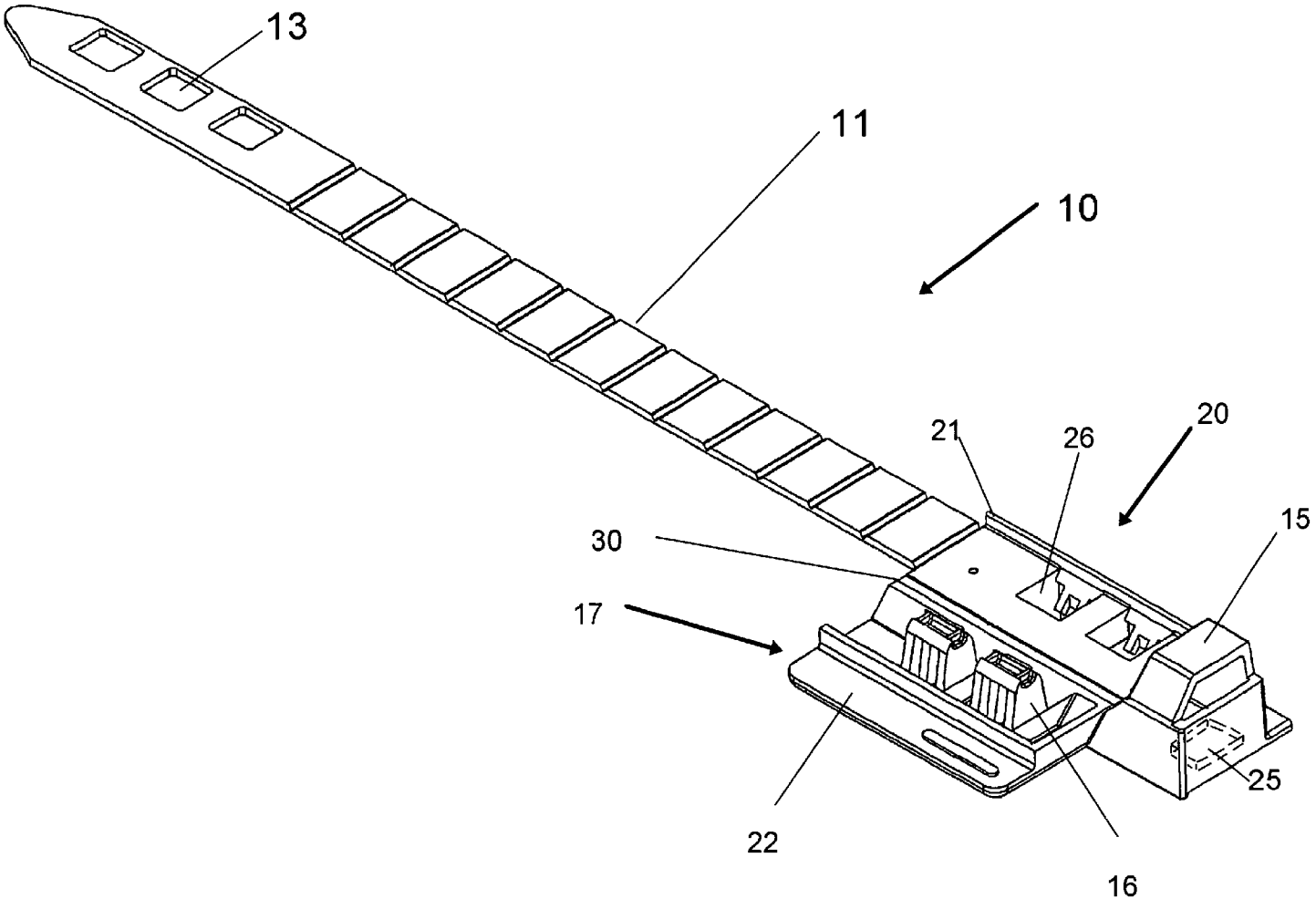
FIG. 1 is a perspective view of the security device with an asymmetric locking mechanism.

FIG. 1 shows a perspective view of the security device 10 having a strap portion 11 and a locking mechanism portion 20. The strap portion 11 is flexible and is placed though an aperture of an article to be tagged. The strap portion 11 then passes through the band 15 on the locking mechanism portion 20 and is guided along wall 21 thus forming a closed loop and securing an item. The apertures 13 on the strap portion 11 are sized and spaced to allow engagement member pods 16 to pass therethrough. When the apertures 13 are aligned with tine member pods 26 the door portion 17 on the locking mechanism 20 swings on hinge 30 allowing engagement member pod 16 to engage the tine member pod 26. The hinge may be a thinned portion of the material of the locking mechanism portion so that the door portion is integral with the tab locking mechanism portion 20. The strap portion 11 is then lockingly secured to the locking mechanism portion 20.

The locking mechanism portion 20 has an electronic article surveillance (EAS) tag 25 secured inside of the body thereof such that the EAS tag 25 cannot be removed from the security device 10. The EAS tag 25 sounds an alarm if the security device and the item it is attached to passes a detector located near a store exit. In this manner shoplifting is deterred.

Figure 2:
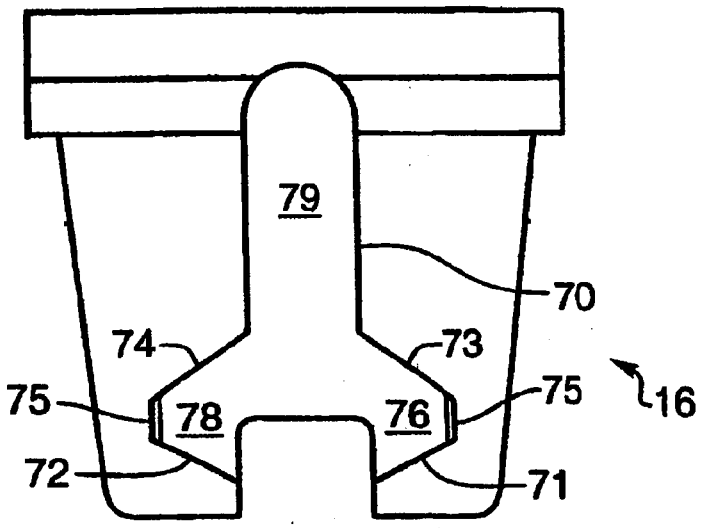
FIG. 2 is a side view of the engagement member.
Figure 3:
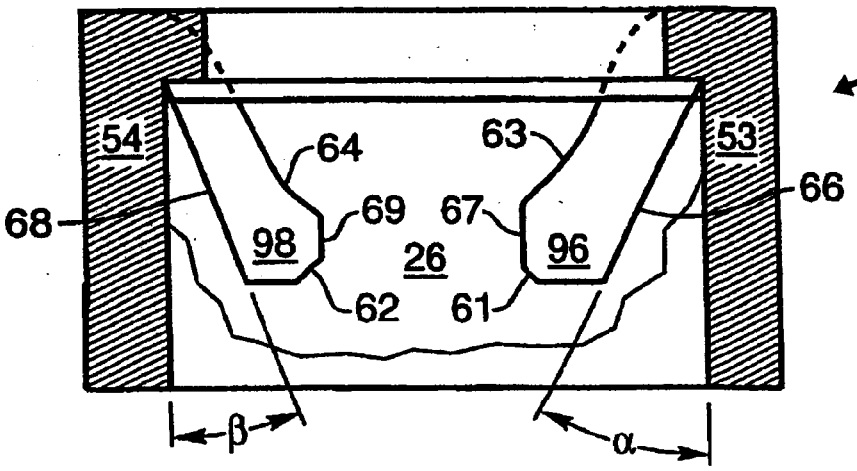
FIG. 3 is a side view of the angled tine members.
Figure 4:
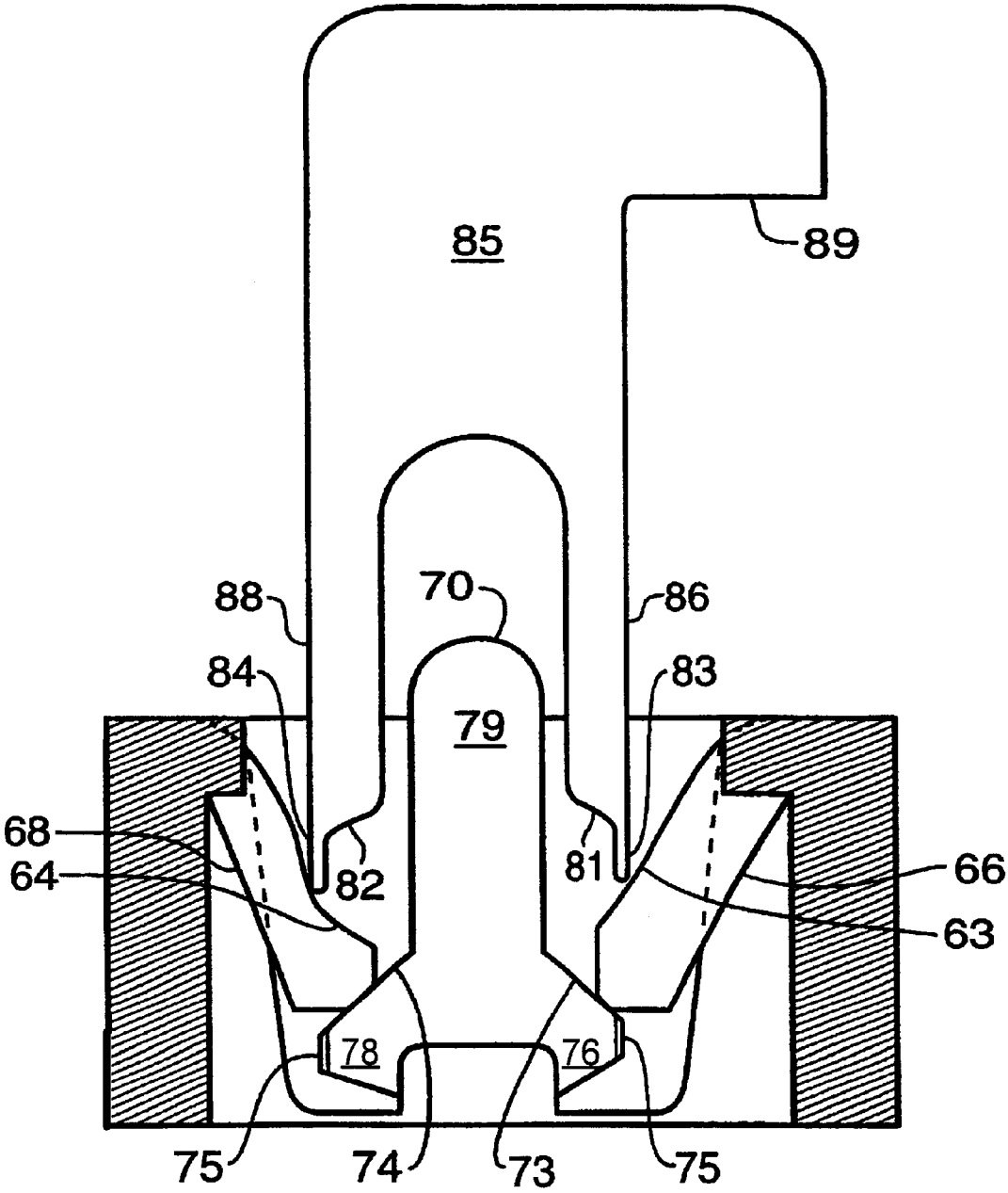
FIG. 4 is a side view of the angled tine member proximate the engagement member in the locked position with an asymmetric key for opening the asymmetric locking mechanism.
Figure 5:
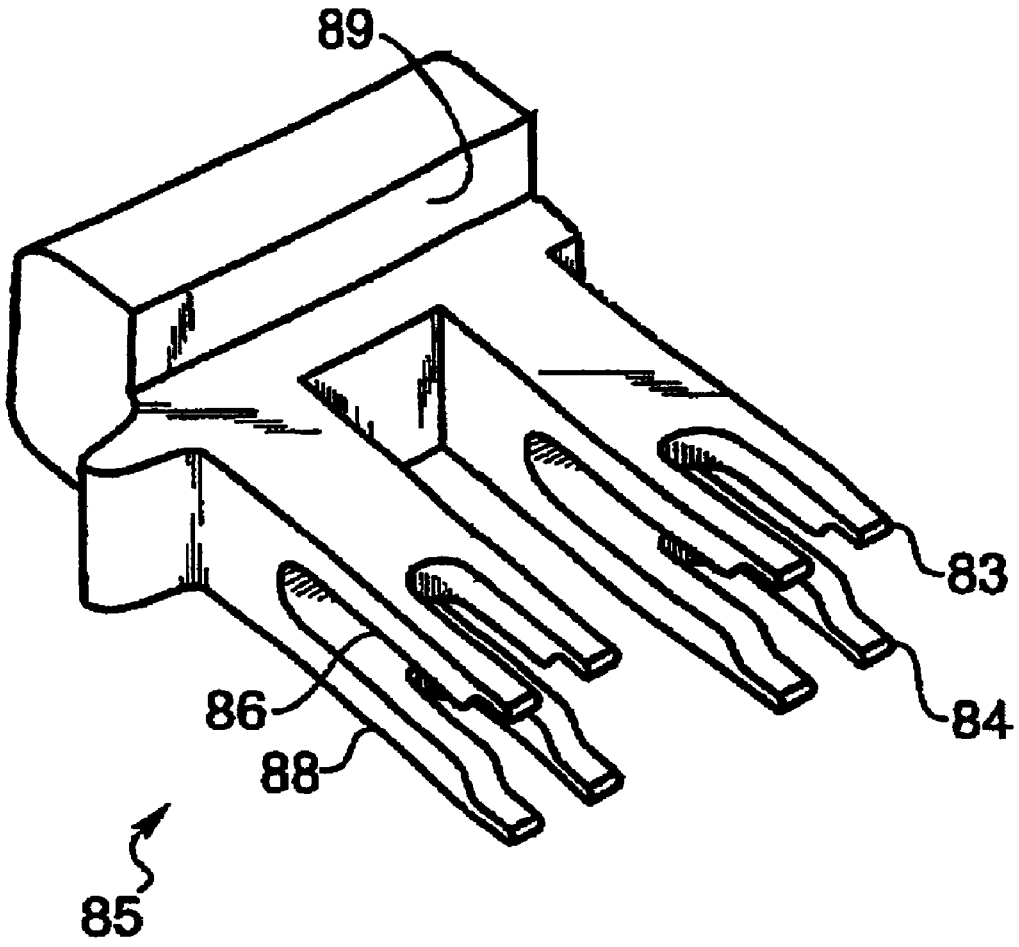
FIG. 5 is a perspective view of the asymmetric key.

Although the security device will function with any locking mechanism such as a male portion fitting into and lockingly engaged with a female portion, a preferred locking mechanism for securing of the security device is an asymmetric tine mechanism as shown in FIGS. 2, 3 and 4, which can be opened with an asymmetric key as shown in FIGS. 4 and 5.

FIG. 2 shows a side view of a portion of an asymmetric engagement member 70 in engagement member pod 16. The asymmetric engagement member 70 has a right engagement member portion 76 and a left engagement portion 78 which have right and left angled bottom portions 71 and 72 respectively right and left angled top portions 73 and 74. The angled portions 71, 72, 73, 74 of the asymmetric engagement member 70 all have different angles. The asymmetric engagement member also has a trunk portion 79.

FIG. 3 shows a side view of a portion of a tine member pod 26 with a right tine member 66 and a left tine member 68. The tine members 66, 68 are deflected by a portion of the angles $\alpha$ and $\beta$ of the right tine member 66 and the left tine member 68 respectively relative to the right and left pod walls 53, 54 in order to move the tine members 66, 68 to lock and unlock when engaged by right engagement member portions 76 and a left engagement member portions 78 of asymmetric engagement member 70. It should be noted that the right tine member base portion 96 is thicker at the base than the rest of the right tine member 66. Similarly the left tine member base portion 98 is thicker at the than the rest of the tine member 68.

As can be understood from FIGS. 2 and 3 when viewed together the locking the locking mechanism works as follows. The asymmetric engagement member 70 will push apart the right and left tine members 66 and 68 by contact with the angled bottom portions 71, 72 and angled surfaces 63 and 64 of the tine members 66 68. When the asymmetric engagement member 70 has spread the tine members 66, 68 apart sufficiently the parallel portions 75 and 67, 69 slide past each other. After the right and left tine members 66, 68 pass the parallel portions 75 of the asymmetric engagement member 70, the engaging surfaces 61 and 62 of the right and left time members 66 and 68 are adjacent the angled top portions 73, 74 of the right and left engagement members portions 76, 78. As seen in FIG. 4, the angles of the surfaces match for parallel engagement such that the asymmetric engagement member 70 cannot be withdrawn from the locking mechanism without spreading apart the right and left tine members 66, 68.

In order to unlock the locking mechanism an asymmetric key 85 is required as shown in FIG. 4. The key 85 must be inserted into the top of engagement pod member 16. The asymmetric key 85 has key long thin arms 86, 88 which just fit into spaces in the pod member 16 and push aside the right and left tine members 66, 68 by contacting them on the angled surfaces 63, 64 with the tip portions 83, 84 of key arms 86, 88. The key 85 is shaped like the asymmetric engagement member 70 wherein the angles 81, 82 on the key arms 86, 88 match the angles of the angled top portions 73, 74 of the asymmetric engagement member 70. Without this asymmetric matching the key 85 will not open the locking mechanism. The trunk 79 of the engagement member 70 fits into the asymmetric key 85 between the arms 86, 88 and restricts access to the tines 66, 68 by other objects which may be used to try to open the security device 10. As the key 85 pushes the right and left tine members 66, 68 away, the tip portions 83, 84 are adjacent parallel portions 75 of the right and left engagement member portions 76, 78 allowing the asymmetric engagement member to be withdrawn upward and the right and left tine members 66, 68 to spring back to their rest positions in the unlocked configuration.

The matching asymmetry of the key 85 and the asymmetric engagement member's 70 right and left tine members 66, 68 are a security feature as a symmetric key will not work with the asymmetric parts. The asymmetry also deters attempts to open the security strap 10 by other implements.

The plateau 89 of the asymmetric key 85 tells the user which way the asymmetric key 85 fits in the engagement aperture 16 as seen in FIG. 2. The plateau 89 of the asymmetric key 85 will be aligned with the handle 22 on door portion when the key is properly inserted in the engagement aperture 16 to operate the lock mechanism.

The handle 22 allows for easily swinging the door portion 17 to the open position for removing the engagement member portion 16 from the tine member pod 26. The strap portion 11 can then be removed from the band 15 and from the article the security device 10 is attached to. The security device 10 is then available to be used on other items.

The patents U.S. Pat. No. 6,102,200 Security Package with Asymmetric Lock to Dressen et al. issued Aug. 15, 2000, U.S. Pat. No. Des. 343,356 Security Package to Witman issued Jan. 18, 1994, and U.S. Pat. No. 5,601,188 Security Package with Internal Pocket for a Surveillance Tag, to Dressen et al. issued Feb. 11, 1997 are all made a part hereof and incorporated herein by reference.

Locking mechanisms other than the asymmetric locking mechanism may be used. Symmetric locking mechanisms of the type described may be used. Locking mechanisms of other designs may also be used in conjunction with the strap 11 to lock the strap to the security device locking mechanism portion 20.

Obviously, many modifications and variations of the present invention are possible in light of the above teachings. It is therefore to be understood that, within the scope of the appended claims, the invention may be practiced otherwise than as specifically described.

What is claimed is:

1. An anti-theft security device comprising:

a strap portion having at least two apertures therein, a locking mechanism portion on the strap portion, the locking mechanism portion having, at least two female tine member pods having tines therein, for alignment with the apertures on the strap portion, the tines having a base portion, the female tine member pods having walls with at least one of said tines extending from opposing right and left walls downward into the pods, the left tines having a uniform length and the right tines having a uniform length, and a door portion hingedly attached to the locking mechanism portion, the door portion having at least two male engagement member pods for insertion through the apertures in the strap and insertion into the at least two female tine member pods, the male engagement member pods having an engagement member with right and left bottom portions for spreading the tines apart during the locking process, and a single right and a single left top portion for engaging the base portion of the tines, when the male engagement portion extends below the base portion of the tines locking the female tine member portion in place, thereby securing the strap to the locking mechanism portion by engaging the tines in the female tine member pods.

2. An anti-theft security device as in claim 1 further comprising:

an electronic article surveillance tag inside of the locking mechanism portion for setting off alarms.

3. An anti-theft security device as in claim 1 further comprising:

a key, the key having arms for engaging and pushing aside the tines to allow the male engagement member pod to disengage the tines thereby unlocking the locking mechanism.

4. An anti-theft security device as in claim 1 further comprising:

a band attached to the locking mechanism portion for receiving and holding the strap portion.

5. An anti-theft security device as in claim 1 further wherein:

the tines are asymmetric tines the engagement member pod having a compatible asymmetric shape to match the asymmetric tines.

6. An anti-theft security device as in claim 1 further wherein:

the key is an asymmetric key compatible with the asymmetric tines and asymmetric engagement member pod such that non asymmetric keys with the proper dimensions will not be able to open the security device.

* * * * *